US006310533B2

(12) United States Patent
Coulombier

(10) Patent No.: US 6,310,533 B2
(45) Date of Patent: Oct. 30, 2001

(54) WATER-RESISTANT ENCAPSULATION OF SOLENOID

(75) Inventor: Olivier P. Coulombier, Holcomb, NY (US)

(73) Assignee: Cliftronics, Inc., Clifton Springs, NY (US)

( * ) Notice: Subject to any disclaimer, the term of this patent is extended or adjusted under 35 U.S.C. 154(b) by 0 days.

(21) Appl. No.: 09/789,105

(22) Filed: Feb. 20, 2001

Related U.S. Application Data

(63) Continuation-in-part of application No. 09/356,722, filed on Jul. 20, 1999, now abandoned.

(51) Int. Cl.[7] ..... H01F 27/02

(52) U.S. Cl. ..... 336/90; 336/96; 336/205

(58) Field of Search ..... 324/174, 207; 335/299, 260; 336/92, 96, 90, 205; 428/447, 207.15; 252/389.62

(56) References Cited

U.S. PATENT DOCUMENTS

| | | | | |
|---|---|---|---|---|
| 4,233,583 | | 11/1980 | Novacek | 335/236 |
| 5,138,292 | | 8/1992 | Forster | 335/278 |
| 5,181,004 | | 1/1993 | Johnson | 336/198 |
| 5,204,044 | * | 4/1993 | Yoneshige | 264/272.15 |
| 5,424,704 | | 6/1995 | Dolle | 335/296 |
| 5,665,429 | | 9/1997 | Elkwakil | 427/218 |
| 5,710,535 | | 1/1998 | Goloff | 336/192 |
| 6,076,550 | * | 6/2000 | Hiraishi et al. | 137/550 |

* cited by examiner

*Primary Examiner*—Anh Mai
(74) *Attorney, Agent, or Firm*—Eugene Stephens & Associates

(57) ABSTRACT

This invention relates to the resin encapsulation of solenoids to achieve water resistance at pressure depth. When a compatible and bondable resin is used to form a solenoid bobbin, to insulate the lead-in wires and to encapsulate the solenoid, the resulting encapsulation is effective in resisting water penetration. The formation of bonds between the encapsulation and the solenoid bobbin flanges and insulated lead-in wires allows the encapsulated solenoid to resist water penetration and to operate efficiently in underwater environments.

26 Claims, 3 Drawing Sheets

WATER-RESISTANT ENCAPSULATION OF SOLENOID

RELATED APPLICATIONS

This application is a Continuation-In-Part of allowed parent application Ser. No. 09/356,722, filed Jul. 20 1999, entitled WATER-RESISTANT ENCAPSULATION OF SOLENOID, the parent application being abandoned upon the filing of this Continuation-In-Part application.

TECHNICAL FIELD

Water-resistant encapsulation of solenoids allowing underwater operation.

BACKGROUND

Manufacturers have encapsulated solenoid coils in plastic to make the coils resistant to water penetration. This process has protected solenoids against minimal pressure water spray, but it has been unable to protect solenoids to withstand submersion to pressure depth.

Solenoid failure is common and troublesome in high-moisture and underwater environments. Unfortunately, numerous applications expose solenoids to moisture and submersion. As a result, there is a great need for solenoids that can reliably resist water penetration and can operate effectively when submerged.

This invention defines a new way to encapsulate solenoids, making them resistant to water, even at significant depths and pressures. This improvement aims at a low cost solenoid that operates reliably underwater.

SUMMARY OF THE INVENTION

This invention introduces a new way to make solenoids water resistant by using compatible and bondable resins to effectuate bonds that are capable of resisting penetration by water. Several bonds must meet this requirement. The encapsulating resin must bond to the resin flanges of a bobbin holding the winding, and the encapsulating resin must bond to the resin insulation of the lead-in wires connected to the solenoid. Forming the bobbin, the lead-in wire insulation, and the encapsulation all of the same or a similar resin ensures compatibility and leads to secure bonds, providing a suitable resin is selected.

A resin suitable for the required bonds is not necessarily optimum for a solenoid bobbin, so it is preferred that the bobbin have a reinforcing core. The bobbin flanges preferably have extra surface area to facilitate rapid heat transfer and bonding during encapsulation. Also, since a housing is often used with a solenoid, the encapsulation is preferably accomplished within a housing. Before using the housing in this way its interior should, preferably, be coated with polytetrafluoroethylene or a similar material to prevent the encapsulating resin from bonding to the housing. Otherwise, the encapsulating resin could crack due to the expansion and contraction of the metal housing during normal in-use temperature cycling.

The resulting encapsulated solenoid is capable of resisting water penetration to significant depths and pressures and operates reliably in a variety of environments.

DRAWINGS

DETAILED DESCRIPTION

Figure 1:
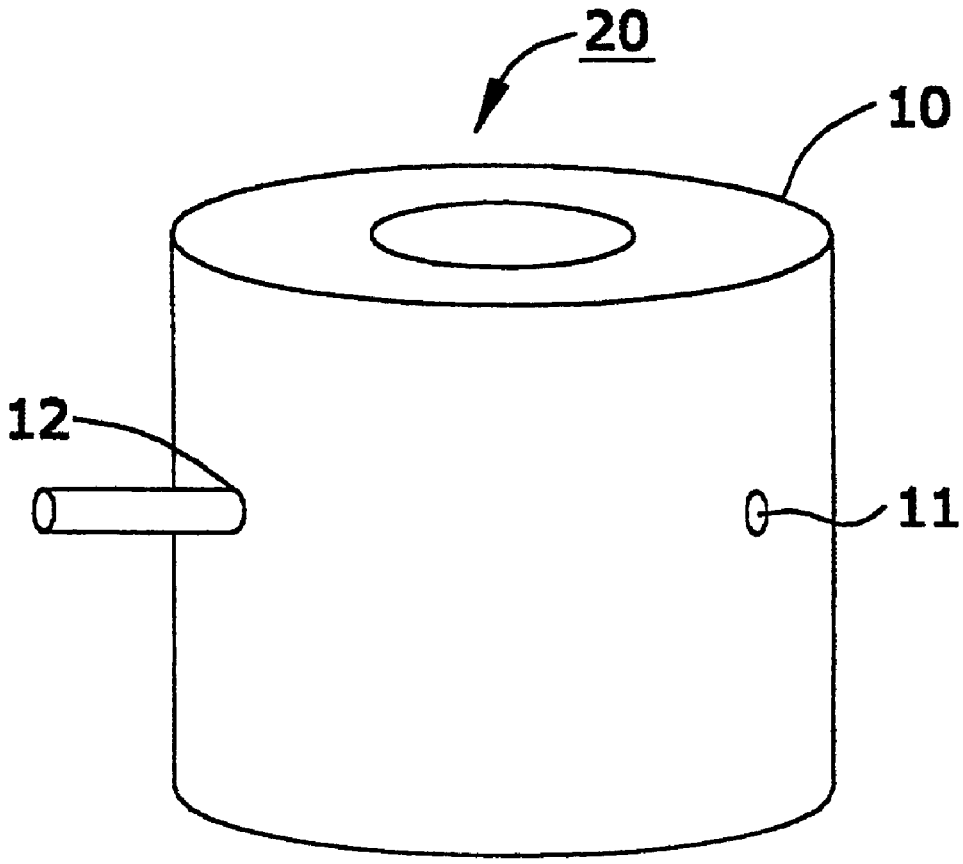
FIG. 1 is a schematic view of the solenoid housing.
Figure 2:
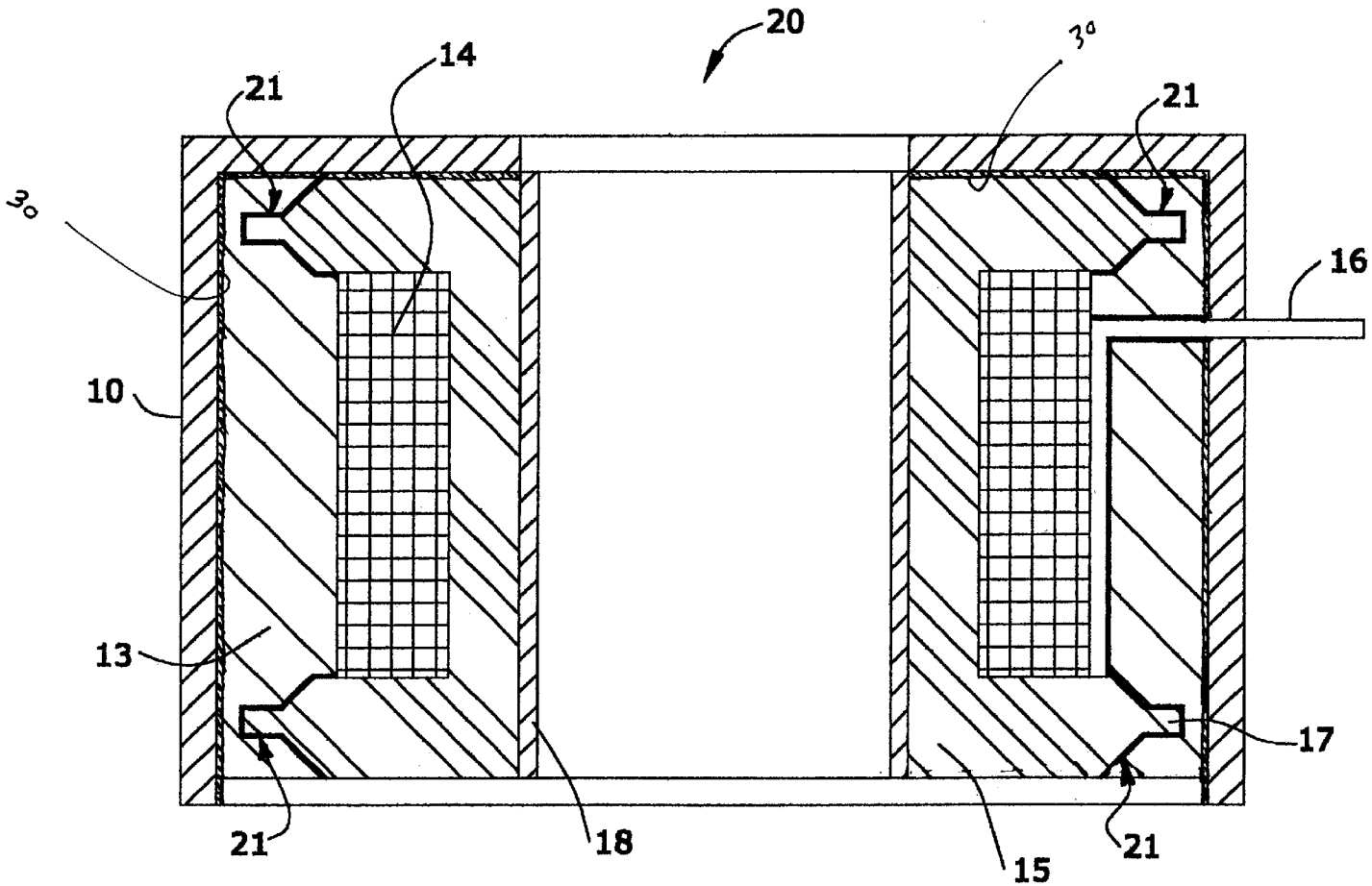
FIG. 2 is a cross-sectional view of the solenoid after encapsulation.
Figure 3:
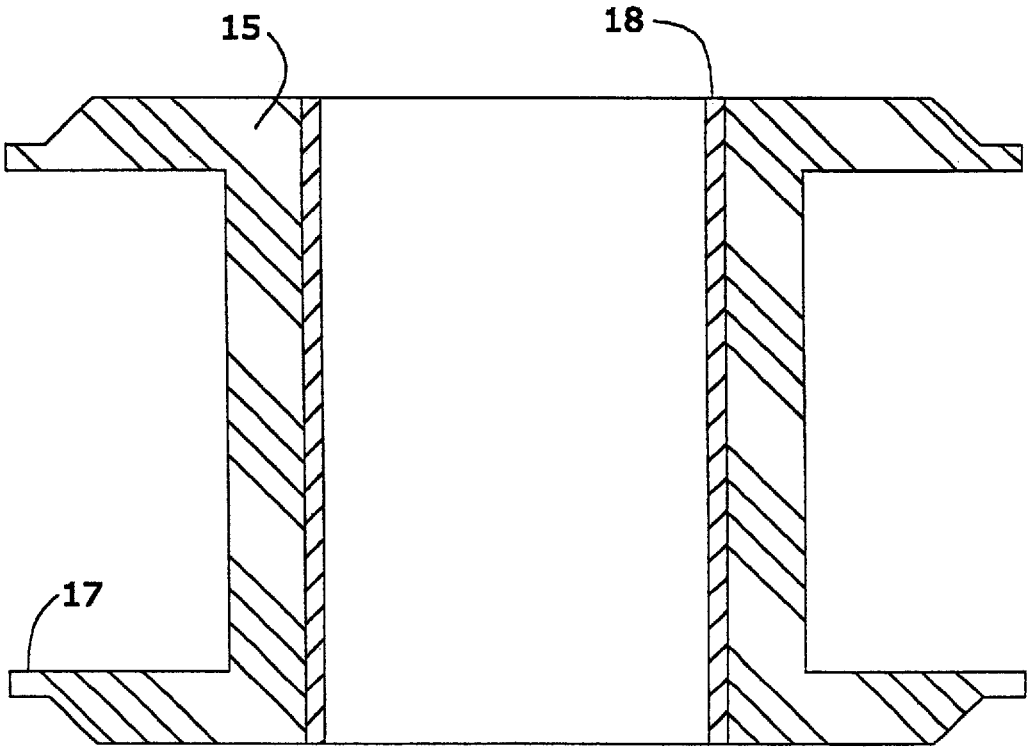
FIG. 3 is a cross-sectional view of the resin bobbin and the reinforcing core used to strengthen it.

Moisture-related solenoid failure is a common problem. In the past, manufacturers were troubled by leaking lead-in wires that connect the solenoid to a circuit board. A leaking lead-in wire can allow water to seep through a gap between the wire and its insulation, causing either solenoid or circuit board failure. This problem was solved through the use of an ionically cross-linked thermal plastic polymer; more specifically, the Du Pont ionomer sold under the trademark SURLYN was found to be particularly effective in protecting lead-in wires. SURLYN, originally developed for use in golf ball covers, bonds well with electric wires. In addition to its ability to bond with electric wire, SURLYN is a very flexible resin. Its flexibility allows it to move and bend with the wire while maintaining a bond that prevents water flow between it and the wire. SURLYN's ability to bond to wires and its great flexibility make it an effective insulating material for protecting against penetration by water.

The effectiveness of SURLYN as an insulation for lead-in wires led me to consider the possibility of using SURLYN or a similar resin to encapsulate a solenoid. The creation of an ionomer resin encapsulated solenoid presented many unanticipated obstacles, though.

To form an ionomer encapsulated solenoid capable of resisting water penetration, several bonds must be formed. Researchers attempting to encapsulate solenoids have experienced great difficulty in forming a water-resistant bond between the encapsulating plastic and the solenoid bobbin. Traditionally, solenoid bobbins are made of nylon so that they can withstand the force exerted on them during the winding of the solenoid coil. While nylon has excellent structural rigidity, it does not bond well with most resins. The poor bonding of nylon with other resins has made the encapsulation of solenoids extremely difficult. The resulting encapsulations have weak bonds and are incapable of resisting pressurized water.

On the other hand, SURLYN is an "ionomer", meaning that it is a thermal plastic polymer that is ionically cross linked. Typically, ionomers are formed through the reaction of copolymers to form bonds between the acid groups within a chain and those of neighboring chains. In the case of SURLYN, ethylene and methacrylic or simply acrylic acid copolymers partially react with metallic salts. Various grades of SURLYN are available and can be used to encapsulate solenoids as long as they are sufficiently compatible with and bondable to each other. Likewise, resins other than SURLYN can be used for encapsulation as long as they exhibit the desired compatibility. While resins other than SURLYN can be used, because SURLYN has been proven as an effective resin for the insulation of solenoid lead-in wires, it is the preferred resin.

Most plastics have a higher melting temperature than SURLYN. As a result, these plastics melt away the SURLYN insulation on the lead-in wires, making bond formation between the wires and the encapsulation difficult. In addition to having a low melting point, SURLYN is highly compatible with and bondable to itself. The low melting point and compatibility of SURLYN allow for the formation of a strong bond between a SURLYN encapsulation and SURLYN insulated lead-in wires. The only remaining obstacle is to achieve effective bonding between the SURLYN encapsulation and the solenoid bobbin. To achieve a sufficient bond between the encapsulation and the bobbin, the bobbin was made of SURLYN.

The SURLYN bobbin 15 is far less rigid than conventional nylon bobbins so that simply substituting SURLYN for nylon leaves a bobbin too weak. Making the bobbin thicker would provide the needed rigidity. However, this is not always possible for solenoids that have size limitations. Generally, SURLYN solenoid bobbins should be comparable in strength and size to a traditional nylon bobbin.

The preferred solution where space is limited is to provide the bobbin with a reinforcing core 18. The addition of the reinforcing core 18 supplies the added strength without having to increase the size of the bobbin 15. Although the reinforcing core 18 can be made of metal or plastic, metal is preferred; and more specifically, copper or an alternative non-ferrous metal is preferred so that the reinforcing core 18 does not interfere with the magnetic flux path of the solenoid 20.

The bobbin 15 and the coil 14 are then encapsulated. Encapsulation can be accomplished within a housing or a mold. However, since solenoids are often used with a housing that concentrates the magnetic flux path of the solenoid, it is preferred that the encapsulation be formed within a solenoid housing 10.

The bobbin 15 and wound wire coil 14 are centered within the housing 10, preferably with the aid of a pin (not shown). The SURLYN insulated lead-in wires 16 are connected to the coil 14 and are then positioned through a second opening 12 in the housing 10.

Once the bobbin 15 and coil 14 are centered within the housing 10, a volume of encapsulating resin 13 is injected. The injection of the encapsulating resin 13, whether done in a housing or a mold, should preferably occur at a point between the bobbin flanges 17. The encapsulating resin 13 is preferably injected through an opening 11, positioned at a point in the side wall of the housing 10 equidistant from both bobbin flanges 17. Central positioning of the injection opening 11 ensures that the encapsulating resin 13 reaches the upper and lower bobbin flanges 17 at the same time. The injection of the resin 13 through the central opening 11 forces the resin 13 to travel an equal distance to each flange 17. This allows the resin 13 to cool enough so that when it reaches the flanges 17, its temperature is the same upon reaching each flange 17. We prefer to inject the encapsulating resin 13 at a temperature and pressure sufficient to ensure efficient bonding between the flanges 17 and the encapsulation 13. If the encapsulating resin 13 is injected through an opening positioned closer to one flange 17 than the other, it could melt the nearest flange 17 completely and result in insufficient melting and bonding with the remaining flange 17. The result would be equally undesirable if the encapsulating resin 13 were injected through the open end of the housing 10. Finally, the encapsulating resin 13 should be injected at a rate slow enough so that the wound wire coil 14 is not disrupted and rapid enough so that complete encapsulation is accomplished prior to re-solidification.

Encapsulation is achieved through the formation of bonds 21 between the encapsulating resin 13 and the flange peripheries 17 of 30 the bobbin 15 and the insulation of the lead-in wires 16. (Bonds 21 are indicated in a general manner by the thickening of the lines denoting the boundaries between the encapsulating resin 13 and the flange peripheries 17 of bobbin 15 and the insulation of lead-in wires 16.) Bond 21 formation occurs when the heated encapsulating resin 13 contacts and partially melts the flange peripheries 17 of the bobbin 15 and the insulation of the lead-in wires 16. To achieve the most efficient bonding between the encapsulation 13 and the bobbin 15, the flange peripheries 17 are preferably configured with extra surface area. Various configurations can be used to provide the additional surface area. For instance, the flanges can be configured with ridges, grooves, or bumps. The flanges might also be configured in the shape of fins, or they may be tapered to supply added surface area. Regardless of the configuration chosen, greater surface area allows for more effective heat transfer and melting and facilitates bond 21 formation between the encapsulating resin 13 and the bobbin 15.

The resin encapsulation 13 does not need to form a direct bond with the wire coil 14 to make the solenoid resistant to water penetration. In fact, the wire coil 14 is covered with an insulating tape (not shown) that holds the coil 14 in place during the injection of the encapsulating resin 13. While a bond can form between the encapsulation 13 and the insulating tape, the encapsulation 13 does not bond directly with the wire of the wound coil 14. Furthermore, a bond between the wire coil 14 and the encapsulation 13 is not required since the bond between the flanges 17 and the encapsulation 13 is secure enough to resist water penetration.

An additional bond can also form between the encapsulation 13 and the interior wall of the housing 10. The formation of this bond, however, is not essential in making the solenoid water resistant. Indeed, it can cause the encapsulating resin 13 to crack due to the expansion and contraction of metal housing 10 during normal in use temperature cycling. This, in turn, can allow sea water to penetrate the solenoid 20, leading to deterioration of solenoid function. I have dealt with this by adding a non-adherent coating 30 to the interior of housing 10. Enhanced polytetrafluoroethylene ("PTFE") is highly suitable for this purpose. Enhanced PTFE coatings offer the uniform deposition and hardness of electroless nickel plating enhanced with the lubricity and release characteristics of a PTFE fluorocarbon. Encapsulation 13 will not adhere to coating 30 when it is formed from enhanced PTFE.

Enhanced PTFE coating 30 is a composite consisting of an electroless nickel alloy plating (also termed autocatalytic nickel) incorporating PTFE. Electroless nickel plating is a process for depositing nickel alloy on a surface relying on chemical rather than electrical energy. It is typically accomplished by submersion of the entire part to be coated. (In this case, housing 10.) This results in the plating of both the interior and the exterior of housing 10. However, the exterior or other portions that do not require plating can be masked if plating of the interior surfaces alone is desired. In either case, the plating surface created confers a degree of lubricity on the plated surfaces of the component. Further advantages in performance and lubricity are achieved by plating a composite coating consisting of an electroless nickel matrix containing second phase particles which impart additional advantageous low lubricity properties. The electroless nickel matrix provides an ides supporting medium for the approximately 25 volume percent of soft submicron particles of PTFE in the enhanced PTFE coating 30. However, many other low lubricity coating materials are available and could also be suitable for use in coating 30. These include a variety of PTFE type coatings as well as low lubricity non-PTFE coatings.

Once encapsulated, the solenoid 20 is capable of resisting water penetration to depths of at least 600 feet and pressures of at least 300 psi. Upper limits of depth and pressure have not yet been reached. The ability to resist both submersion and pressurized water spray makes our encapsulated solenoid 20 capable of reliable operation in a variety of high moisture environments.

I claim:

1. A solenoid encapsulated to be water resistant, the solenoid comprising:

a. a bobbin molded of resin and configured to have a coil-supporting region extending axially between a pair of end flanges, the bobbin having an axial opening extending through the coil-supporting region between the end flanges;

b. a coil of wire wound on the coil-supporting region of the bobbin between the end flanges;

c. a tubular reinforcing core fitted within the axial opening to extend between the end flanges and strengthen the coil-supporting region of the bobbin;

d. the end flanges each having an outer flange portion extending radially beyond an outside diameter of the wire coil and an inner flange portion extending radially to an outside diameter of the wire coil;

e. the outer flange portion of the end flanges being thinner than the inner flange portion of the end flanges;

f. a solenoid housing containing the resin bobbin, the reinforcing core, and the wound wire coil;

g. resin insulated lead wires running from the wound wire coil within the solenoid housing out through an opening in the housing;

h. a volume of encapsulating resin molded within the housing, the encapsulating resin being compatible with and forming water-resistant bonds with the resin forming the bobbin and with the resin insulating the lead wires; and i. the encapsulating resin forming water-resistant bonds with the bobbin flange and with the resin insulating the lead wires within the housing so that the encapsulating resin encloses the wound wire coil, in a water-resistant encapsulation formed within the housing.

2. The encapsulated solenoid of claim 1, wherein the water-resistant bonds between the encapsulating resin and the bobbin flanges and between the encapsulating resin and the resin insulation of the lead wires are secure enough to resist penetration by water to the wire coil when the solenoid is submerged in water to a depth of at least 600 feet.

3. The encapsulated solenoid of claim 1, wherein the tubular reinforcing core is metal.

4. The encapsulated solenoid of claim 1, wherein the resin used to form the solenoid bobbin, the resin used to insulate the lead-in wires, and the resin used to encapsulate the solenoid is an ionomer made from a reaction of ethylene and acrylic acid copolymers with metallic salts.

5. A water-resistant solenoid comprising:

a. a bobbin molded of resin supporting a solenoid coil wound between flanges of the bobbin;

b. an encapsulating resin compatible with and bonded to the bobbin resin and molded around the bobbin and the coil to form a water-resistant bond between the bobbin flanges and the encapsulating resin;

c. lead-in wires to the solenoid coil insulated with a resin compatible with and bonded to the encapsulating resin to achieve a water-resistant bond between the encapsulating resin and the resin insulation of the lead-in wires; and d. the bobbin, the lead-in wire insulation, and the encapsulating resin are each made from an ionomer formed by reacting ethylene and acrylic acid copolymers with metallic salts.

6. The solenoid of claim 5, wherein the resin bobbin has a tubular metal reinforcing core.

7. The solenoid of claim 5, wherein the bonds between the encapsulating resin and the bobbin flanges and between the encapsulating resin and the resin insulation of the lead-wires are secure enough to resist penetration of the coil by water when the solenoid is submerged in water to a depth of at least 600 feet.

8. The solenoid of claim 5, including a metal housing around the encapsulated solenoid, and the encapsulating resin is molded within the metal housing and bonds to the resin bobbin and to the resin insulation on the lead-in wires within the metal housing.

9. A solenoid-encapsulating method comprising:

a. mold a resin bobbin with end flanges, each such end flange having an inner flange portion and an outer flange portion, where the outer flange portion is formed thinner than the inner flange portion;

b. position a metal reinforcing tube within a core of the resin bobbin;

c. wind wire on the resin bobbin to form a coil;

d. connect the coil to resin insulated lead wires;

e. provide a solenoid housing with openings;

f. position and center the resin bobbin within the solenoid housing;

g. position the resin insulated lead wires so that they pass through an opening in the solenoid housing;

h. inject a volume of encapsulating resin through an opening in the housing, filling the space between the housing and the resin bobbin and the wound wire coil before re-solidifying; and i. control injection temperature and pressure of the encapsulating resin to form water-resistant bonds between the encapsulating resin and the bobbin flange peripheries and between the encapsulating resin and the resin insulation of the lead wires.

10. The method of claim 9, including injecting the encapsulating resin through the housing in a region mid-way between the outer flange portions.

11. The method of claim 9, including using an ionomer made from a reaction of ethylene and acrylic acid copolymers with metal salts to form the resin bobbin, the resin insulation on the lead wires, and the encapsulating resin.

12. The method of claim 9, wherein the encapsulation is formed so that the water-resistant bonds make the solenoid water resistant to depths of at least 600 feet.

13. A method of creating a water-resistant encapsulation for a solenoid comprising:

a. forming a bobbin supporting a solenoid coil and forming insulation for lead-in wires to the solenoid coil of resin that is compatible with and forming water-resistant bonds with an encapsulating resin used to encapsulate the solenoid;

b. strengthening the resin bobbin by positioning a metal reinforcing tube within a core of the bobbin;

c. placing the resin bobbin and the coil and the lead-in wires within a mold;

d. injecting the encapsulating resin into the mold in a region mid-way between flanges of the bobbin at opposite ends of the solenoid coil; and e. controlling injection temperature and pressure for the encapsulating resin to form water-resistant bonds between the encapsulating resin and radial peripheries of the bobbin flanges and between the encapsulating resin and the resin insulation on the lead-in wires.

14. The method of claim 13, including using a metal housing for the solenoid as the mold for the encapsulating resin and arranging the lead-in wires to pass through an opening in the housing.

15. The method of claim 13, including the step of selecting an ionomer resin for the encapsulation, the bobbin, and the lead-in wire insulation.

16. The method of claim 15, wherein the selected ionomer resin is formed by reacting ethylene and acrylic acid with metallic salts.

17. A water-resistant encapsulation allowing a solenoid to operate effectively in underwater environments, the encapsulation comprising:

a. a solenoid bobbin formed of an ionomer resin made by reacting ethylene and acrylic acid copolymers with metallic salts;

b. a solenoid coil wound on the bobbin between flanges of the bobbin, and the bobbin flanges having peripheries extending radially beyond an outside diameter of the solenoid coil;

c. lead-in wires connected with the solenoid coil being insulated with an ionomer resin made by reacting ethylene and acrylic acid copolymers with metallic salts;

d. an encapsulation formed of an ionomer resin made by reacting ethylene and acrylic acid copolymers with metallic salts; and e. the encapsulation resin being molded to be bonded to the bobbin flange peripheries and to the resin insulating the lead-in wires so as to prevent water from penetrating into the coil.

18. The water-resistant encapsulation of claim 17, including a metal tube arranged within the bobbin to strengthen the bobbin against deformation as the coil is wound on the bobbin.

19. The water-resistant encapsulation of claim 17, wherein the bobbin flanges are thicker proximate the solenoid coil and thinner proximate their peripheries.

20. The water-resistant encapsulation of claim 17, including a metal housing enclosing the bobbin, and the encapsulating resin being molded within the metal housing.

21. The water-resistant encapsulation of claim 17, wherein the bond between the encapsulating resin and the bobbin flanges and the bond between the encapsulating resin and resin insulating the lead-in wires resist water penetration at water depths of at least 600 feet and at water pressures of at least 300 psi.

22. A water-resistant solenoid comprising:

a. a bobbin molded of resin supporting a solenoid coil wound between flanges of the bobbin;

b. an encapsulating resin compatible with and bonded to the bobbin resin and molded around the bobbin and the coil to form a water-resistant bond between the bobbin flanges and the encapsulating resin; and c. a metal housing around the encapsulated solenoid, and the encapsulating resin is molded within the metal housing and bonds to the resin bobbin within the metal housing, the metal housing having an interior surface to which the encapsulating resin is not substantially adherent.

23. The water-resistant solenoid of claim 22, wherein said interior surface includes a low lubricity material.

24. The water-resistant solenoid of claim 22, wherein said interior surface includes polytetrafluoroethylene.

25. The water-resistant solenoid of claim 22, wherein said interior surface includes electroless nickel.

26. The water-resistant solenoid of claim 22, wherein said interior surface includes enhanced PTFE.

* * * * *